US007731512B1

(12) United States Patent
Montena et al.

(10) Patent No.: US 7,731,512 B1
(45) Date of Patent: Jun. 8, 2010

(54) GROUNDING BRACKET FOR USE WITH CABLE CONNECTORS

(75) Inventors: Noah Montena, Syracuse, NY (US); David Jackson, Manlius, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 12/398,857

(22) Filed: Mar. 5, 2009

(51) Int. Cl.
*H01R 4/66* (2006.01)
*H01R 13/648* (2006.01)

(52) U.S. Cl. ..... 439/108; 439/97; 439/939

(58) Field of Classification Search ..... 439/108, 439/95, 97, 545, 553, 564, 939, 101; 174/74 R, 174/78, 75 C; D13/133; 248/65
See application file for complete search history.

(56) References Cited

U.S. PATENT DOCUMENTS 4,386,814 A * 6/1983 Asick ..... 439/607.28
5,192,216 A * 3/1993 Knauber et al. ..... 439/108
5,317,105 A * 5/1994 Weber ..... 174/355
5,838,550 A * 11/1998 Morris et al. ..... 361/818
5,856,632 A * 1/1999 Bostrom et al. ..... 174/354
5,885,103 A * 3/1999 Ernolf et al. ..... 439/579
5,959,244 A * 9/1999 Mayer ..... 174/369
6,227,868 B1 5/2001 Wlodarski
6,276,970 B1 8/2001 Wong
D459,304 S * 6/2002 Malin ..... D13/133
D459,305 S * 6/2002 Malin ..... D13/133
D459,306 S * 6/2002 Malin ..... D13/133
D486,791 S * 2/2004 Franks, Jr. ..... D13/133
6,808,426 B2 10/2004 Liu
6,877,996 B1 * 4/2005 Franks, Jr. ..... 439/92
6,899,563 B1 5/2005 Lee
D508,676 S * 8/2005 Franks, Jr. ..... D13/133
D512,376 S * 12/2005 Franks, Jr. ..... D13/133
6,976,884 B1 12/2005 Lee
7,041,903 B2 5/2006 Odahara et al.
7,059,875 B2 * 6/2006 Kunimoto ..... 439/95
7,462,042 B2 * 12/2008 Chawgo ..... 439/97
2006/0030181 A1 2/2006 Blake et al.
2006/0094270 A1 5/2006 Engler
2008/0153328 A1 6/2008 Ho

* cited by examiner

*Primary Examiner*—Hae Moon Hyeon
(74) *Attorney, Agent, or Firm*—George R. McGuire; Bonds Schoeneck & King, PLLC

(57) ABSTRACT

A grounding bracket for use with cable connectors, such as an F81 barrel connector, generally including a conductive body having a first major surface, a connector receiving area defined in the first major surface and adapted to receive the cable connector therein, and a latch member movably connected to the first major surface and positioned in communication with the connector receiving area.

41 Claims, 7 Drawing Sheets

GROUNDING BRACKET FOR USE WITH CABLE CONNECTORS

BACKGROUND OF THE INVENTION

The present invention relates generally to grounding brackets, and more particularly to grounding brackets used in association with connectors for audio-visual signal carrying cables, such as coaxial cable barrel connectors.

Coaxial cable barrel connectors, such as F81 type barrel connectors, are used to link coaxial cables together within satellite, antenna, and cable television systems. Often, little thought is given to the F-81 barrel connector. However, satellite systems in particular, use high frequency signals, and the connectors must therefore have high frequency performance. As satellite services increase offerings, so too does the bandwidth of the satellite system to transport these services. As bandwidth is increased, higher frequencies are employed to transport additional video channels and this challenges the integrity of the F-81 connector.

Inconsistencies from connectors and components within the cable path reduce the quality of the satellite signal at the satellite receiver. In an ideal situation in a satellite communication, for instance, a cable would simply connect the satellite receiver to the satellite antenna. In reality, however, cable splices, wall plates and, grounding brackets/blocks exist between components in the satellite antenna system. Every splice positioned in the cable path adds a potential inconsistency to the cable link. As the inconsistencies increase, the satellite signal within the cable becomes distorted. Signal distortion increases until the satellite receiver fails to receive certain satellite channels—often first evident with the weaker satellite transponder signals. Therefore it is important to use an F-81 connector and associated components that imposes the smallest negative effect in the cable path.

Grounding brackets or blocks ensure a proper ground path between the drop cable and a ground wire. If there is corrosion of the bracket material or a gap in the connection between the cable connector and the bracket, improper grounding can result, degrading the quality of the signal being transported through the cables. Conventional grounding brackets/blocks include a barrel connector integral with the bracket (typically die cast), or a separate barrel connector and bracket that are permanently affixed to one another by a press fit.

With integral barrel blocks, inconvenience and/or unnecessary cost are incurred when a system encounters a variety of installation types with different numbers of lines, as with satellite television. Some subscribers choose service with only one receiver on the dish, while others get service with as many as four receivers, each with a line that must be grounded, while still others have two-line service. Ideally, the system would stock only one type of ground block, but installing a four-line block at sites which only require one or two is costly, and installing four single line blocks is a nuisance.

It is a principal object and advantage of the present invention to provide a grounding bracket for use with signal carrying cable connectors that provide a secure and reliable ground connection for the cable connectors.

It is another object and advantage of the present invention to provide a grounding bracket that can accommodate a plurality of signal carrying cable connectors.

It is a further object and advantage of the present invention to provide a grounding bracket that provides reliable engagement between the cable connector and the bracket.

Other objects and advantages of the present invention will in part be obvious and in part appear hereinafter.

SUMMARY OF THE INVENTION

In accordance with the foregoing objects and advantages, the present invention provides a grounding bracket for use with cable connectors, such as an F81 barrel connector. The bracket generally comprises a conductive body comprising a first major surface, a connector receiving area defined in the first major surface and adapted to receive the cable connector therein, and a latch member movably connected to the first major surface and positioned in communication with the connector receiving area. The bracket further comprises a spring member connected in biased relation to the first major surface and in communication with said connector receiving area. The latch member effectively prohibits rotation of the connector once mounted in the block, while further serving to limit the lateral movement of the connector. The spring member assists in maintaining a solid ground connection between the bracket and the connector.

In an alternate aspect of the present invention, a grounding bracket is provided for use with cable connectors and the bracket generally comprises a conductive body comprising a first major surface, at least two connector receiving areas each defined in the first major surface and each adapted to respectively receive a cable connector therein, and at least two latch members each movably connected to the first major surface and each positioned in communication with a respective one of the at least two connector receiving areas. The bracket further comprises at least two spring members each connected in biased relation to the first major surface and each positioned in communication with a respective one of the at least two connector receiving areas. The at least two connector receiving areas defined in the first major surface may extend from a common edge of the first major surface, or from opposing major surfaces. Furthermore, the axes along which the receiving areas extend may be in parallel relation to one another (when extending from a common edge), co-axial with one another (when extending from opposing edges), or offset from one another.

BRIEF DESCRIPTION OF THE DRAWINGS

The present invention will be more fully appreciated and understood by reading the following Detailed Description in conjunction with the accompanying drawings, in which.

DETAILED DESCRIPTION

Figure 1:
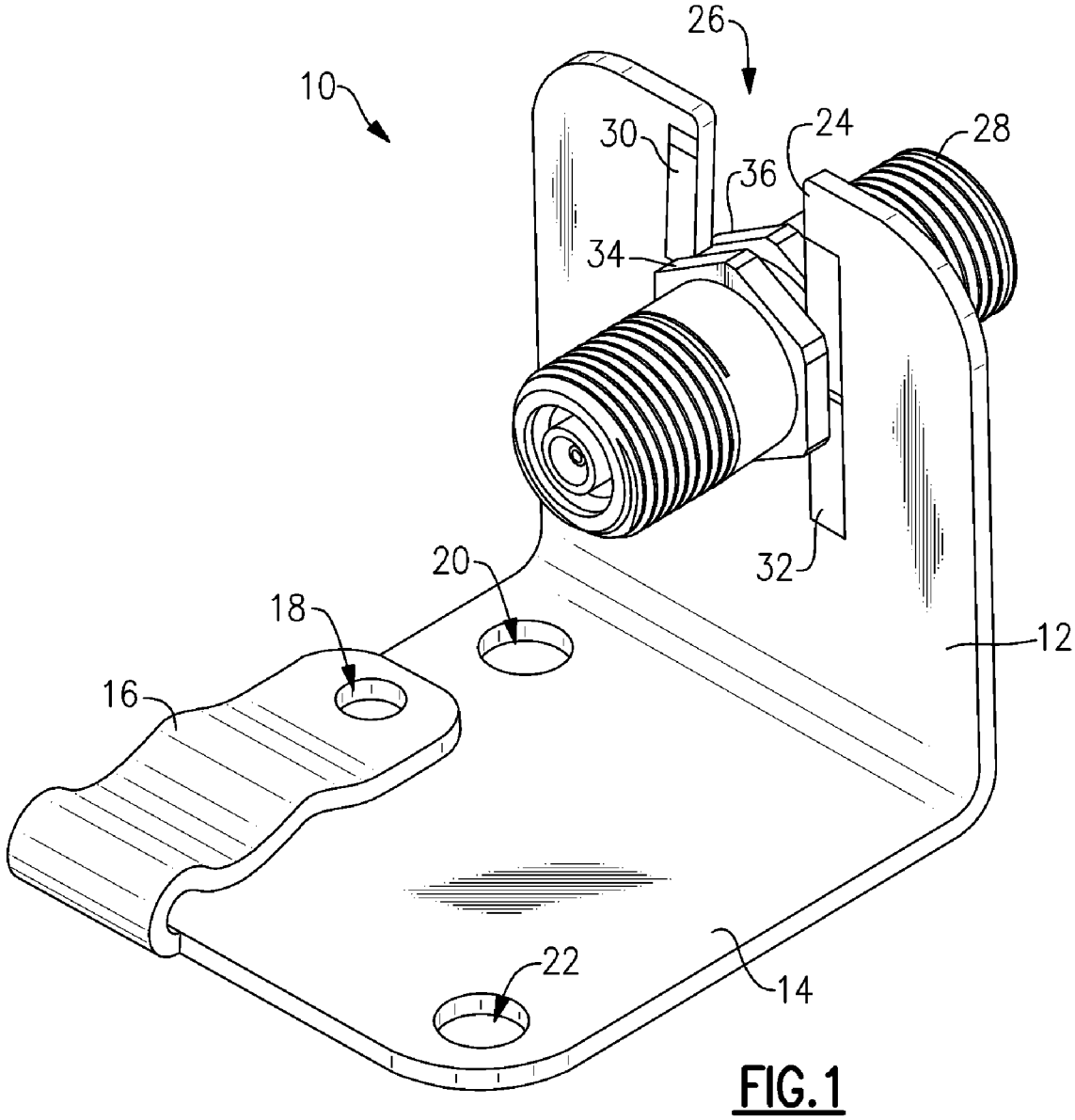
FIG. 1 is a perspective view of a preferred embodiment of the present invention with a cable connector shown seated within the bracket.
Figure 2:
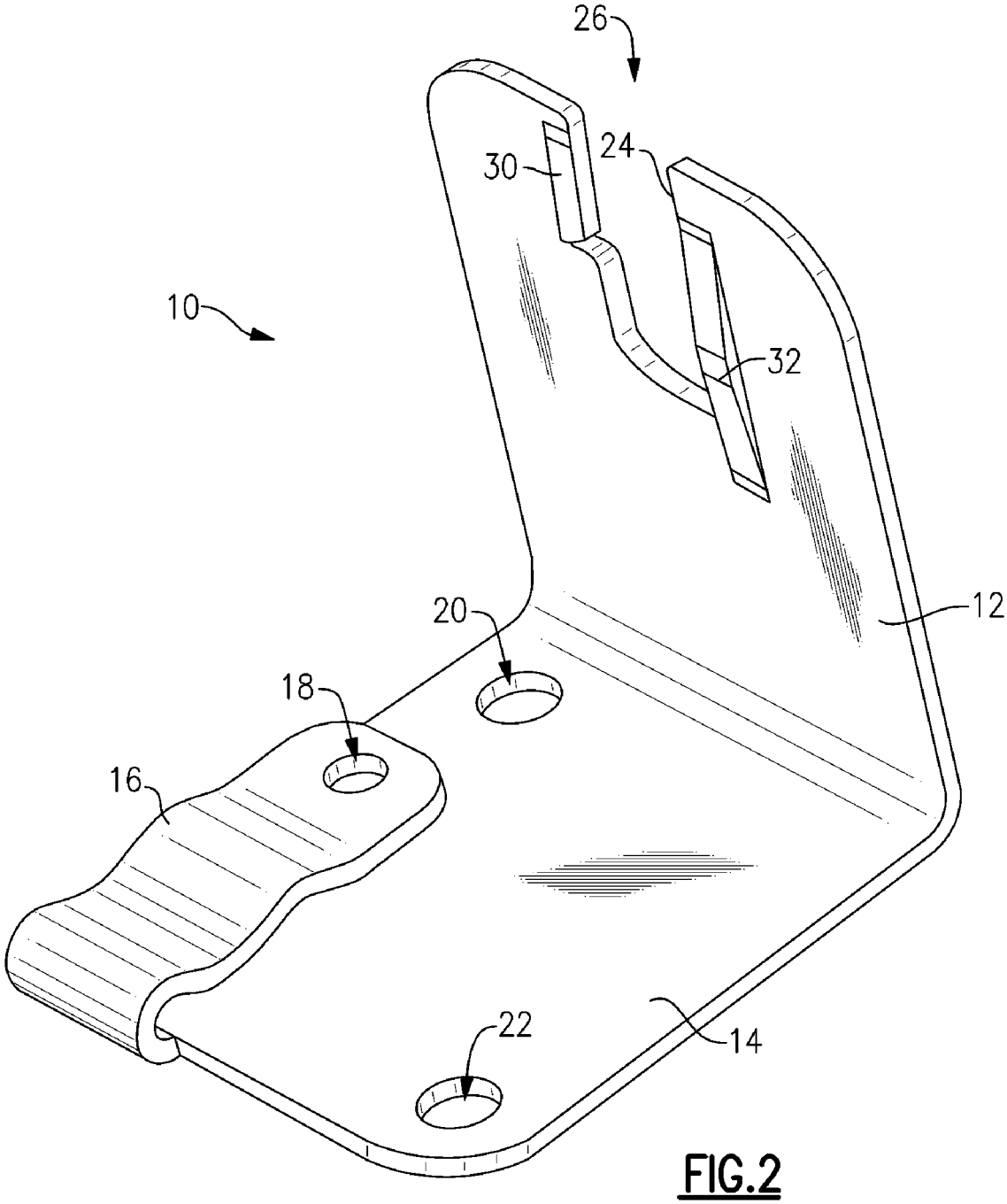
FIG. 2 is a perspective view of a preferred embodiment of the present invention without a cable connector shown in relation to the bracket.
Figure 3:
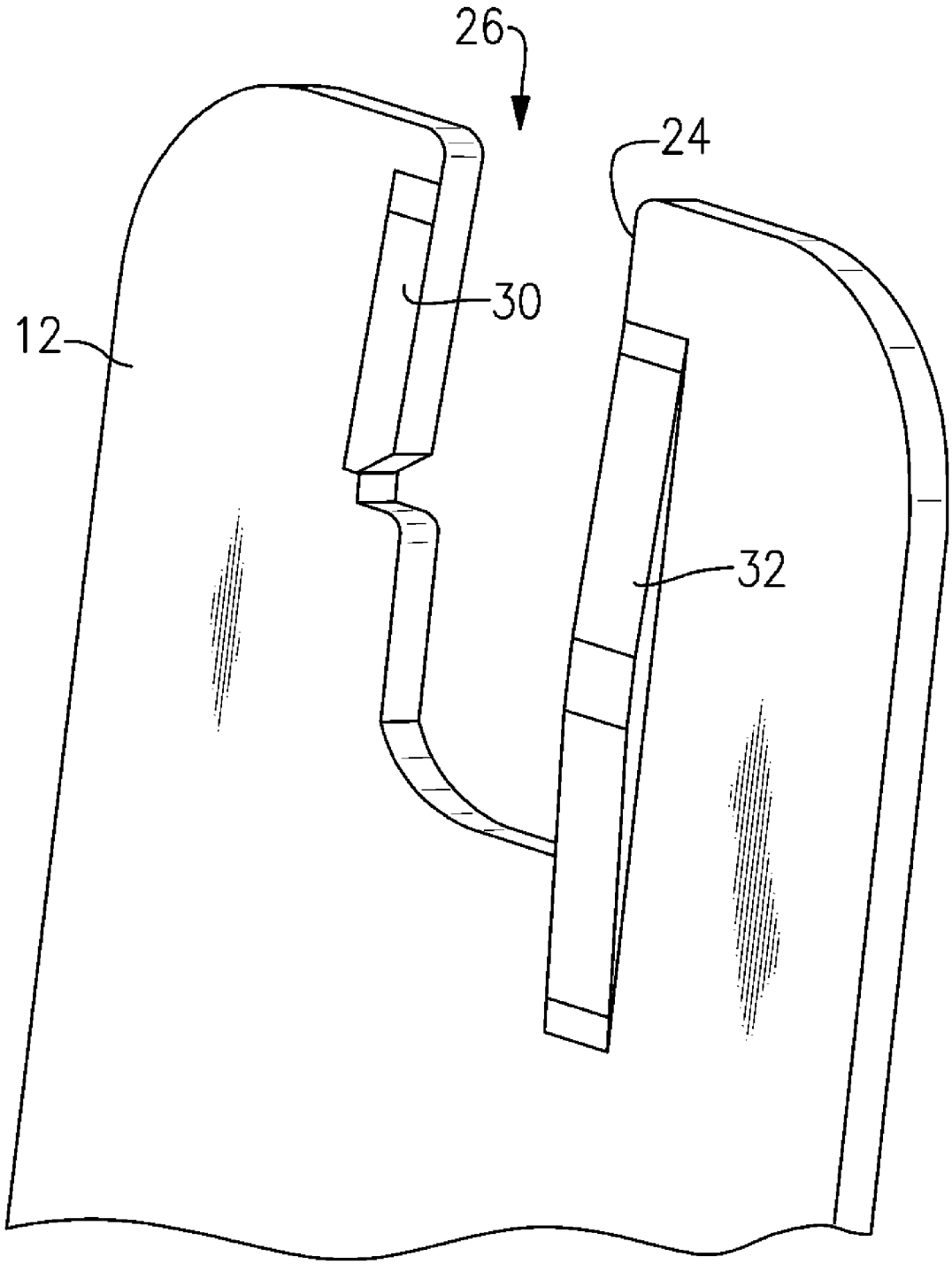
FIG. 3 is an enlarged perspective view of a portion of the present invention within the encircled portion of FIG. 2.

Referring now to the drawings in which like reference numerals refer to like parts throughout, there is seen in FIG. 1 a grounding bracket designated generally by reference numeral 10 comprising a first major surface 12 and a second major surface 14 that extends normally (or at any desired angle) from first major surface 12. A clip 16 integrally extends from one edge of second major surface 14 and includes an aperture 18 formed therethrough to which a conventional grounding wire (not shown) may be anchored. Apertures 20 and 22 are also formed through major surface 14 to provide mounting holes through which a bolt or other fastener may be passed for purposes of securing bracket 10 in position.

A cable connector receiving area 24 is formed in first major surface 12, and comprises an essentially U-shaped groove 26 that extends inwardly from one edge of first major surface 12. Cable connector receiving area 24 is adapted to securely receive a cable connector 28, such as an F81 barrel connector, therein. Bracket 10 includes two features which each increase the reliability and effectiveness of its grounding function: a latch (or locking tab) 30 and a spring contact 32 which will be described in greater detail hereinafter.

Bracket 10 comprises a latch (or locking tab) 30 that extends in cantilevered fashion downwardly from one edge of major surface 12 into the space defined by connector receiving area 24. In the preferred embodiment shown in the drawings, latch 30 is fixed on only one edge to first major surface 12 and consists of a resilient strip of material, preferably stainless steel due to its resiliency and high corrosion resistant properties (although other metals could certainly be used as well), that extends angularly out of the plane of first major surface 12. When a predetermined force (such as caused by a user's finger pushing on the free end of latch) is applied to latch 30, it will bias to an essentially co-planar position relative to first major surface 12, and when the force is released, it will return to its natural out of plane orientation. This structural orientation of latch 30 provides a locking function with respect to a connector 28 mounted to bracket 10, as will be further described hereinafter.

Bracket 10 further comprises a spring contact 32 that is attached to and biased with respect to first major surface 12 and extends into the space defined by connector receiving area 24. Spring contact 32 comprises a strip of conductive material, preferably stainless steel for the same reasons provided with respect to latch 30, that is fixed to first major surface 12 at least at one of its ends (the preferred structure as illustrated in the drawings shows both of its ends being fixed to first major surface 12, but it is certainly conceivable that only one end be fixed). In the preferred embodiment, spring contact 30 is naturally biased out of the plane in which first major surface 12 extends. With the application of a properly directed force, spring contact 32 will move into an essentially co-planar relation with first major surface 12, and will naturally bias towards its out of plane orientation when the force is released. This structural orientation of spring contact 32 provides the function of ensuring strong contact between connector 28 and bracket 10 (and thereby maximize the potential for proper grounding of connector 28), as will be explained in further detail hereinafter.

Figure 6:
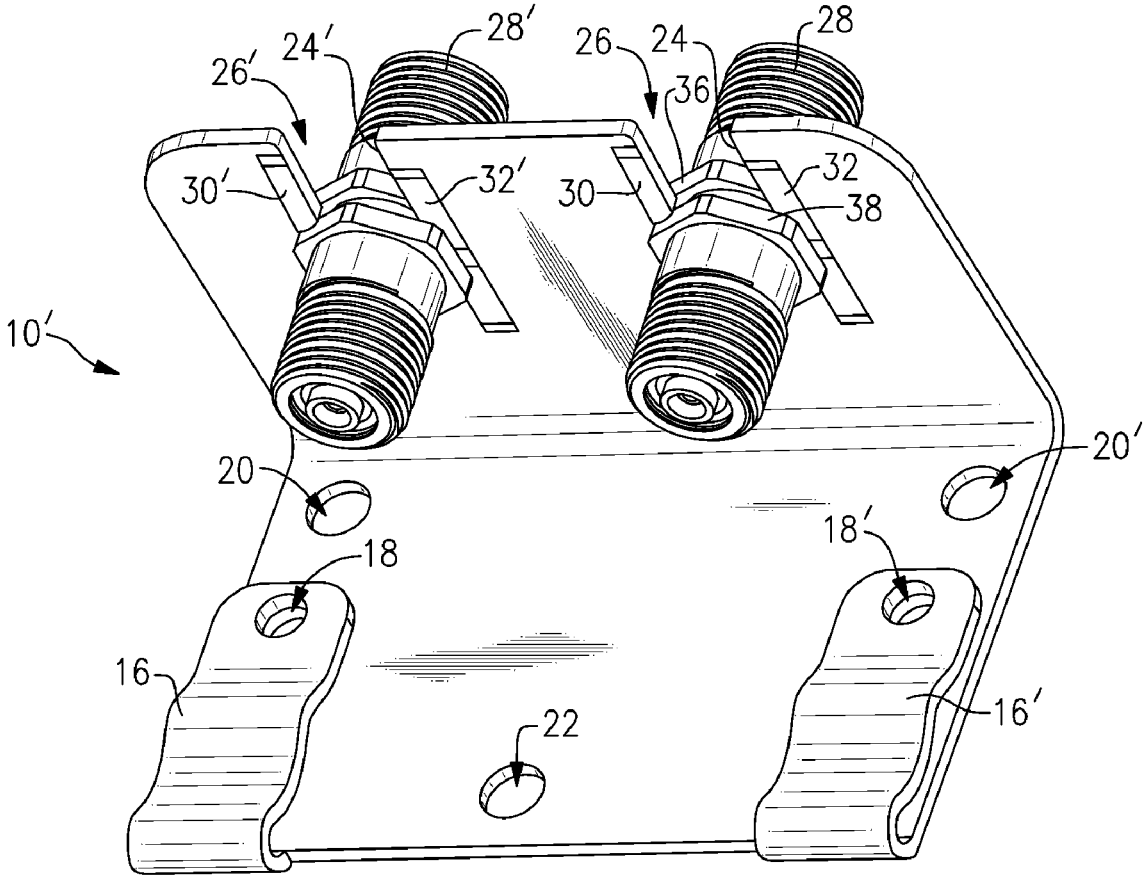
FIG. 6 is a perspective view of a second embodiment of the present invention.
Figure 7:
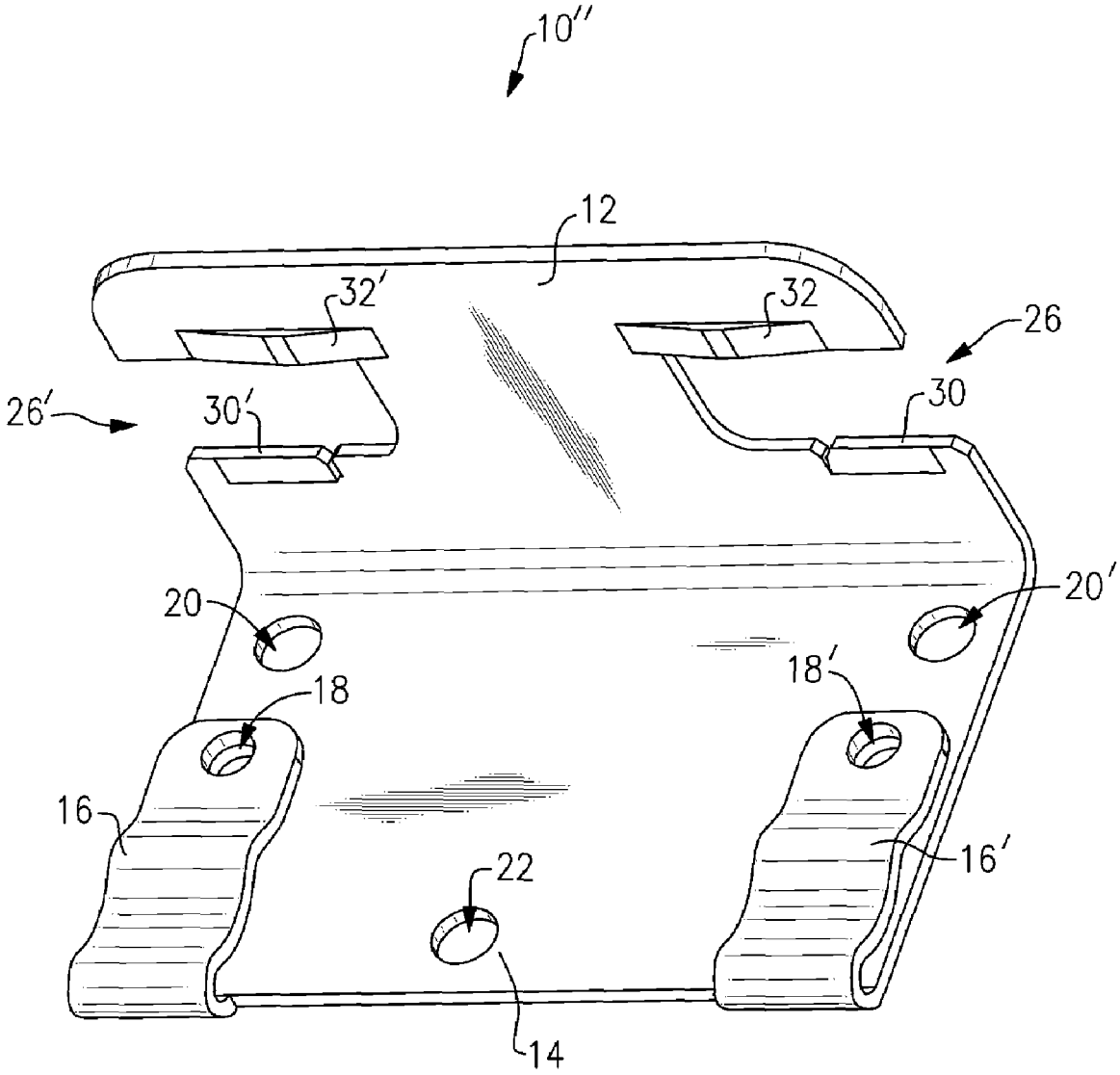
FIG. 7 is a perspective view of a third embodiment of the present invention.

In alternate embodiments of bracket 10 seen in FIGS. 6 and 7, two connector receiving areas 24, 24' are provided. As the only difference between the primary embodiment and the alternate embodiments is the number and location of the connector receiving areas 24, 24' the reference numerals used with the primary embodiment are used to refer to the same parts in the alternate embodiments (with a prime (') symbol designating duplicates of a common part). In the embodiment of FIG. 6, the two connector receiving areas 24, 24' both extend inwardly from a common edge of first major surface 12, whereas in a third alternate embodiment shown in FIG. 7, the two connector receiving areas 24, 24' extend inwardly from two different edges (opposing edges in the embodiment illustrated in FIG. 7), of first major surface 12. In the embodiment of FIG. 6, latch members 30, 30' and spring members 32, 32' each extend along a respective longitudinal axis with each in spaced, parallel relation to the others. In the embodiment of FIG. 7, latch members 30, 30' extend along a common longitudinal axis, and spring members 32, 32' also extend along a common longitudinal axis. It should be understood, that bracket 10 can be modified to include as many connector receiving areas 24 in a single bracket as is desired, with the orientation of the bracket receiving areas being arranged in any desired configuration.

Figure 4:
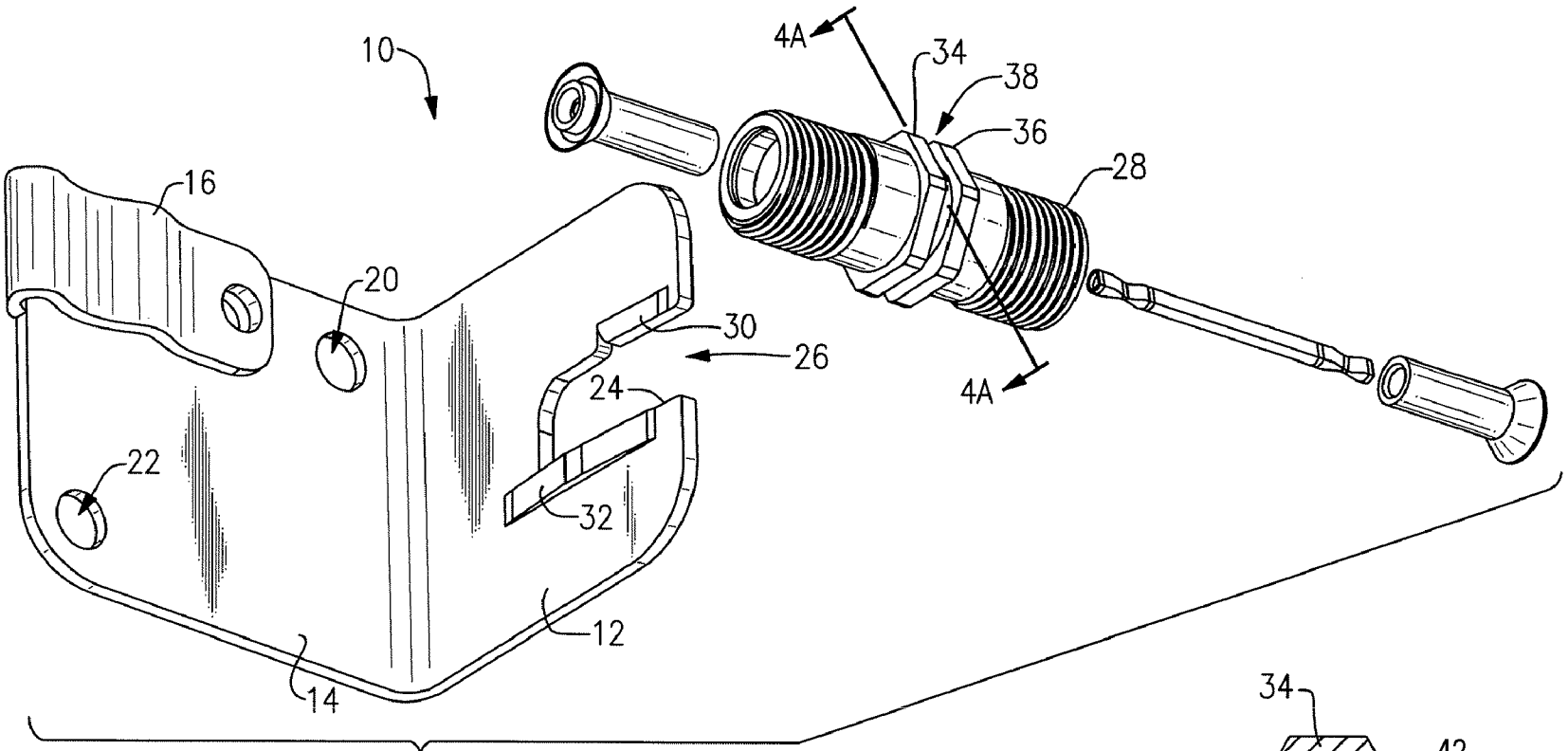
FIG. 4 is an exploded perspective view of the preferred embodiment of the present invention'
Figure 4A:
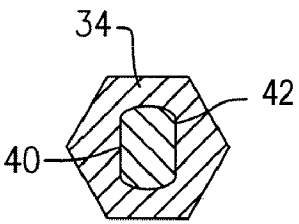
FIG. 4*a* is a cross-section view taken along section line 4*a*-4*a* of FIG. 4.
Figure 5:
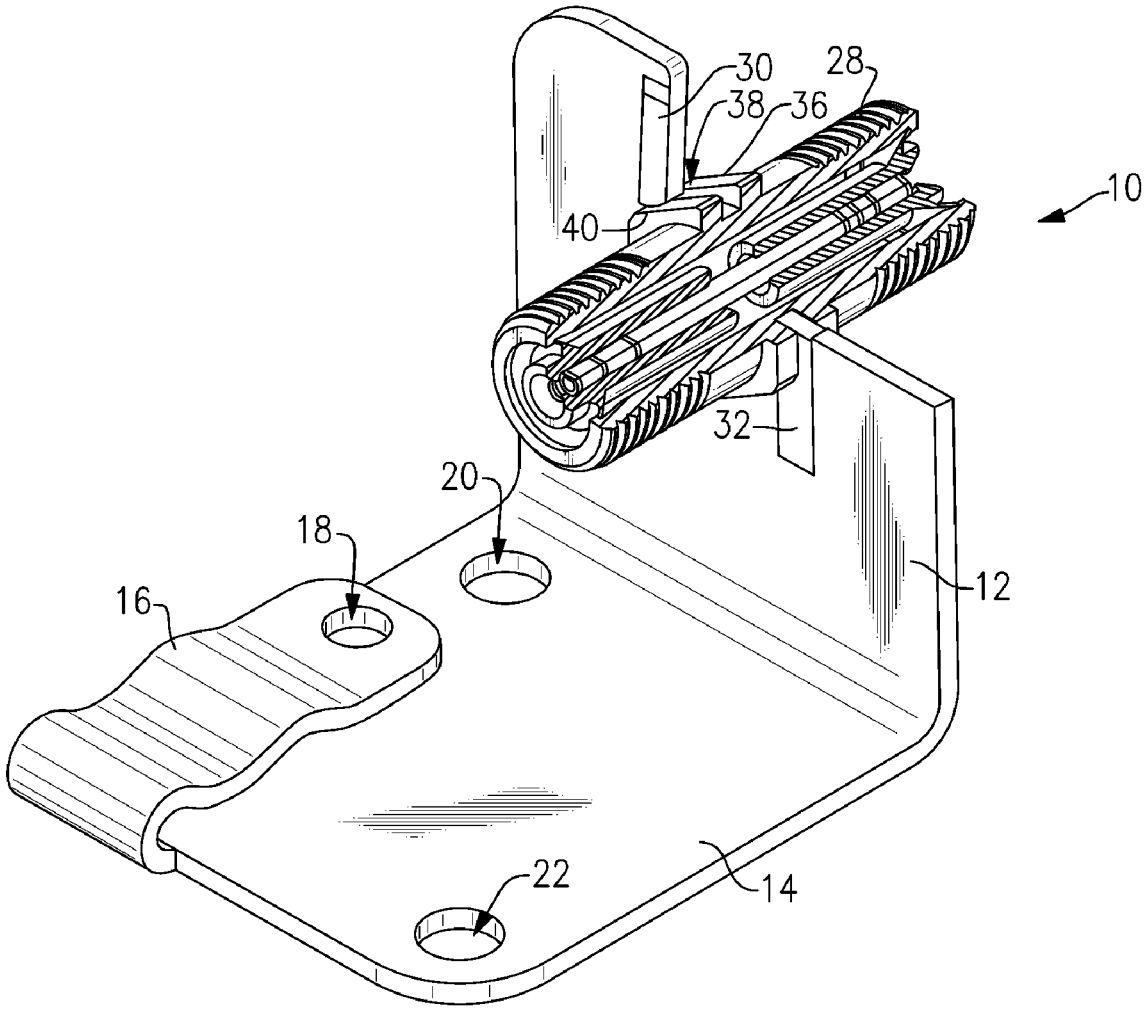
FIG. 5 is a perspective view of the preferred embodiment of to present invention with portions of the cable connector and cable receiving area shown in cross-section.

Bracket 10 is used effectively with a barrel connector 28 formed with two longitudinally spaced apart hex heads (or other shaped heads) 34, 36 that define a gap 38 therebetween. Gap 38 preferably includes opposing flat sections 40, 42 formed thereon. Connector 28 includes the conventional two female ends in which co-axial cable may be operatively inserted and fastened using the threaded connections provided thereon, but its mid-section comprises the two hex-heads 34, 36 which are adapted to straddle first major surface 12 with gap 38 being co-planar therewith. In other words, in attaching connector 28 to bracket 10, gap 38 is slid into connector receiving area 24, 24' with flats 40, 42 (see FIG. 4*a*) being slid along the side edges of the receiving area to prevent rotation of connector 28 while engaged with receiving area 24, and with hex-heads 34, 36 positioned on opposing sides of first major surface 12. In sliding connector 28 down into receiving area 24, latch 30 and spring contact 32 are both biased into essentially co-planar orientations relative to first major surface 12, and within gap 38, thereby providing the clearance for connector 28 to be fully seated within receiving area 24. When fully seated within receiving area 24, latch 30 will naturally bias out of the plane of first major surface 12 and into interfering relation with one of hex-heads 34, 36, and spring contact 30 will flex outwardly into contacting relation with the inwardly facing surface of one of hex-heads 34, 36 which, in turn, forces the other of hex-heads 34, 36 into contacting relation with the exterior facing surface of first major surface 12. While latch 30 effectively prevents inadvertent dislodgement of connector 28 away from bracket 10 by interfering with the lateral movement of the connector, spring contact 32 effectively maintains contact (and hence proper grounding) of connector 28 with bracket 10 by maintaining a constant bias that pushes hex head 34 or 36 into engagement with body 12. Latch 30 further assists in preventing rotation of connector 28 while seated in receiving area 24, thereby preventing the cables being spliced by connector 28 from becoming inadvertently loosened or otherwise disconnected through the rotation of the connector.

While the present invention has been described in relation to its embodiments illustrated in the accompanying drawings, it should be understood that the invention's full scope and spirit are not limited thereby but rather are defined by the appended claims.

What is claimed is:

1. A grounding bracket for use with an elongated cable connector having a longitudinal axis, comprising:

a. a conductive body comprising a first major surface;

b. a connector receiving area defined in said first major surface and adapted to receive the cable connector in a direction transverse to the longitudinal axis of the cable connector; and c. a locking latch member movably connected to said first major surface and positioned in communication with said connector receiving area, wherein said latch member is adapted to prevent rotation of the cable connector positioned within said connector receiving area.

2. The grounding bracket of claim 1, further comprising a spring member connected in biased relation to said first major surface and in communication with said connector receiving area.

3. The grounding bracket of claim 1, wherein said conductive body comprises a second major surface extending from said first major surface.

4. The grounding bracket of claim 3, further comprising a clip extending from said second major surface.

5. The grounding bracket of claim 4, further comprising a ground wire attached to said clip.

6. The grounding bracket of claim 1, wherein said latch member is attached in cantilevered relation to said first major surface.

7. The grounding bracket of claim 1, wherein said latch member is selectively movable to a position that is substantially co-planar with said first major surface.

8. A grounding bracket for use with an elongated cable connector having a longitudinal axis, comprising:

a. a conductive body comprising a first major surface;

b. a connector receiving area defined in said first major surface and adapted to receive the cable connector in a direction transverse to the longitudinal axis of the cable connector; and c. a spring member connected in biased relation to said first major surface and in communication with said connector receiving area, and adapted to bias the cable connector into engagement with said first major surface.

9. The grounding bracket of claim 8, wherein said conductive body comprises a second major surface extending from said first major surface.

10. The grounding bracket of claim 9, further comprising a clip extending from said second major surface.

11. The grounding bracket of claim 10, further comprising a ground wire attached to said clip.

12. The grounding bracket of claim 8, wherein said spring member is attached at its opposite ends to said first major surface.

13. The grounding bracket of claim 8, wherein said spring member is selectively movable to a position that is substantially co-planar with said first major surface.

14. A grounding bracket for use with an elongated cable connector having a longitudinal axis, comprising:

a. a conductive body comprising a first major surface;

b. a connector receiving area defined in said first major surface and adapted to receive the cable connector in a direction transverse to the longitudinal axis of the cable connector; and c. means for ensuring that the cable connector maintains a grounded connection with said conductive body and is biased into engagement with said first major surface.

15. The grounding bracket of claim 14, wherein said means for ensuring that the cable connector maintains a grounded connection with said conductive body comprises a spring member connected in biased relation to said first major surface and in communication with said connector receiving area.

16. A grounding bracket for use with an elongated cable connector having a longitudinal axis, comprising:

a. a conductive body comprising a first major surface;

b. a connector receiving area defined in said first major surface and adapted to receive the cable connector in a direction transverse to the longitudinal axis of the cable connector; and c. means for preventing the cable connector from becoming disengaged from said connector receiving area and preventing rotation of the cable connector positioned within said connector receiving area.

17. The grounding bracket of claim 16, wherein said means for preventing the cable connector from becoming disengaged from said connector receiving area comprises a latch member movably connected to said first major surface and positioned in communication with said connector receiving area.

18. A grounding bracket for use with a plurality of elongated cable connectors each having a respective longitudinal axis, comprising:

a. a conductive body comprising a first major surface;

b. at least two connector receiving areas each defined in said first major surface and each adapted to respectively receive a cable connector in a direction transverse to the longitudinal axis of the cable connector; and c. at least two locking latch members each movably connected to said first major surface and each positioned in communication with a respective one of said at least two connector receiving areas, wherein at least one of the said at least two latch members is adapted to prevent rotation of at least one of said plurality of cable connectors positioned within one of the at least two connector receiving areas.

19. The grounding bracket of claim 18, further comprising at least two spring members each connected in biased relation to said first major surface and each positioned in communication with a respective one of said at least two connector receiving areas.

20. The grounding bracket of claim 18, wherein each of said at least two latch members extend from a common edge of said first major surface.

21. The grounding bracket of claim 18, wherein each of said at least two latch members extend along a respective longitudinal axis each of which are in spaced, parallel relation to one another.

22. The grounding bracket of claim 18, wherein each of said at least two latch members each extend from different edges of said first major surface.

23. The grounding bracket of claim 18, wherein each of said at least two latch members extend along a common longitudinal axis.

24. A grounding bracket for use with a plurality of elongated cable connectors each having a respective longitudinal axis, comprising:

a. a conductive body comprising a first major surface;

b. at least two connector receiving areas each defined in said first major surface and each adapted to respectively receive a cable connector in a direction transverse to the longitudinal axis of the cable connector; and c. at least two spring members each connected in biased relation to said first major surface and each positioned in communication with a respective one of said at least two connector receiving area, wherein at least one of said at least two spring members is adapted to bias at least one of said plurality of cable connectors into engagement with said first major surface.

25. The grounding bracket of claim 24, wherein each of said at least two spring members extend from a common edge of said first major surface.

26. The grounding bracket of claim 24, wherein each of said at least two spring members extend along a respective longitudinal axis each of which are in spaced, parallel relation to one another.

27. The grounding bracket of claim 24, wherein each of said at least two spring members each extend from different edges of said first major surface.

28. The grounding bracket of claim 24, wherein each of said at least two spring members extend along a common longitudinal axis.

29. A method for installing an elongated cable connector having a longitudinal axis into a grounding bracket, the method comprising:

a. inserting the cable connector into a connector receiving area in a direction transverse to the longitudinal axis of the cable connector, said connector receiving area defined in a first major surface of a conductive body; and b. locking the cable connector into the connector receiving area via a latch member movably connected to said first major surface and positioned in communication with said connector receiving area, wherein said latch member is adapted to prevent rotation of the cable connector positioned within said connector receiving area.

30. The method of claim 29, wherein the connector receiving area is in communication with a spring member connected in biased relation to said first major surface.

31. The method of claim 29, wherein said conductive body comprises a second major surface extending from said first major surface.

32. The method of claim 31, wherein said second major surface further comprises a clip.

33. The method of claim 32, wherein said clip further comprises a ground wire.

34. The method of claim 29, wherein the latch member is attached in cantilevered relation to said first major surface.

35. The method of claim 29, wherein the latch member is selectively movable to a position that is substantially coplanar with said first major surface.

36. A method for installing a plurality of elongated cable connectors each one of which includes a longitudinal axis into a grounding bracket, the method comprising:

a. inserting a first cable connector into a first connector receiving area in a direction transverse to the longitudinal axis of said first cable connector, said first connector receiving area defined in a first major surface of a conductive body;

b. inserting a second cable connector into a second connector receiving area in a direction transverse to the longitudinal axis of said second cable connector;

c. locking said first cable connector into said first connector receiving area via a first latch member movably connected to said first major surface and positioned in communication with said first connector receiving area, wherein said first latch member is adapted to prevent rotation of said first cable connector positioned within said first connector receiving area; and d. locking said second cable connector into said second connector receiving area via a second latch member movably connected to said first major surface and positioned in communication with said second connector receiving area, wherein said second latch member is adapted to prevent rotation of said second cable connector positioned within said second connector receiving area.

37. The method of claim 36, wherein at least two spring members are each connected in biased relation to said first major surface and are each positioned in communication with a respective one of said first and second connector receiving areas.

38. The method of claim 36, wherein each of said first and second latch members extend from a common edge of said first major surface.

39. The method of claim 38, wherein each of said first and second latch members extend along a respective longitudinal axis each of which are in spaced, parallel relation to one another.

40. The method of claim 38, wherein each of said first and second latch members extend from different edges of said first major surface.

41. The method of claim 38, wherein each of said first and second latch members extend along a common longitudinal axis.

* * * * *